US005477873A

United States Patent [19]

Ramsey et al.

[11] Patent Number: 5,477,873

[45] Date of Patent: Dec. 26, 1995

[54] ARTIST'S BRUSH WASHING APPARATUS

[76] Inventors: Laurel Ramsey, 6930 NE. 56th St. #102, Altoona, Iowa 50009; C. Thomas Grimes, 618 SW. Des Moines St., Ankeny, Iowa 50021

[21] Appl. No.: 302,611

[22] Filed: Aug. 31, 1994

[51] Int. Cl.[6] ..... B08B 3/04

[52] U.S. Cl. ..... 134/155; 134/186; 141/198; 141/95; 141/364; 222/457

[58] Field of Search ..... 134/44, 155, 186; 137/453, 454; 401/120; 141/198, 95, 366, 364, 309; 118/429; 222/587, 589, 457, 437, 440, 425, 439

[56] References Cited

U.S. PATENT DOCUMENTS

| | | | |
|---|---|---|---|
| 809,439 | 1/1906 | Goeb | 222/439 |
| 1,244,585 | 10/1917 | Case | 222/457 X |
| 1,402,604 | 1/1922 | Harvey | 222/439 |
| 1,408,921 | 3/1922 | Robert | 222/457 |
| 1,559,274 | 10/1927 | Morris | 222/587 |
| 1,946,969 | 2/1934 | Gilbert | 222/589 |
| 1,977,571 | 10/1934 | Brumm | 137/454 |
| 2,017,990 | 10/1935 | Ray | 222/457 |
| 2,149,650 | 3/1939 | Westphal | 222/587 |
| 2,637,336 | 5/1953 | Emery, Jr. | 137/454 |
| 2,678,146 | 5/1954 | Schlief | 222/457 |
| 2,690,280 | 9/1954 | Henningsen | 222/457 |
| 3,145,653 | 8/1964 | Lake | 137/454 X |
| 3,312,374 | 4/1967 | Whitlock | 222/457 |
| 4,449,477 | 5/1984 | Davignon | 222/437 |

*Primary Examiner*—Frankie L. Stinson
*Attorney, Agent, or Firm*—James Birkenholz

[57] ABSTRACT

An artist's brush washing apparatus providing multiple washings of an artist's brush utilizing fresh solvent and facilities for holding contaminated solvent. A top unit includes a washing basin which receives fresh solvent from a solvent reservoir assembly. The top unit overlies a holding pan and a solvent flushing assembly provides for the control and removal of contaminated solvent from the washing basin into the pan and the introduction of fresh solvent into the washing basin from the solvent reservoir assembly.

3 Claims, 5 Drawing Sheets

54
38
16
10
48
50
46
36
56
14
52
40
34
26
28
32
42
30
60
64
60
18
58
22
20
24
12

ARTIST' S BRUSH WASHING APPARATUS

BACKGROUND OF THE INVENTION

1. Field of the Invention

The present invention relates generally to an apparatus for cleaning paint brushes, and more specifically to an artist's paint brush cleaning apparatus providing replenishment of the cleaning solvent and holding facilities for the contaminated solvent.

2. Description of Prior Art

An artist working in the areas of oil, water color, or acrylic mediums will frequently need to make complete color changes which will necessitate the cleansing of their brushes. A thorough and complete cleaning of a brush is important to prevent color contamination from the old color to the new color. The brush is typically washed with a cleaning solvent, i.e., water or turpentine, and the brush immersed within the solvent which is confined to a tin or pan container, of the type disclosed in U.S. Pat. No. 1,901,861 to I. S. Baker. After the first color change., the solvent is contaminated with the color material from the brush which requires dumping of the old solvent and new solvent supplied or contamination of the brush occurs during the next cleaning process. Multiple tins of solvent as taught by Baker permits more than one color change, however, having multiple containers of solvent in the immediate work area is problematic and ultimately the artist must stop painting and dump the old solvent and refill the tins with fresh solvent.

An artist's kit contains multiple solvent containers as further shown in Fredley, U.S. Pat. No. 4,494,267, however, ultimately the artist must again stop painting and empty the containers or otherwise risk contamination of the brush. The disposal of the contaminated solvent can be problematic in that, it simply cannot be thrown without due consideration for the immediately surrounding area. A separate container is required by Fredley and Baker to hold the contaminated solvent until proper and final disposal occurs.

The art further teaches the use of multiple washings wherein the brush would initially be washed in a tin holding contaminated solvent and then subsequently washed one or more times in tins wherein the solvent is less contaminated. This washing cycle ultimately attempts to provide a brush free of color contaminants. The previous problems associated with multiple tins holding solvents can still be problematic.

It is, therefore, the object of the present invention to provide a means for multiple washings of the artist's brush utilizing non-contaminated solvent during each cleansing process.

It is the further object of the present invention to permit multiple washings of the artist's brush without having to stop the painting process and refill the pans holding the solvent.

It is another object of the present invention to provide a means of holding the contaminated solvent until final disposal can occur.

It is another object of the present invention to remove the need for multiple washings of the brush in order to provide the brush free of color contaminants.

The above and many other objects, features, and advantages of the present invention will become more fully understood from the ensuing detailed description of the preferred embodiment, which should be considered in connection with the accompanying drawings.

SUMMARY OF THE INVENTION

An artist's brush washing apparatus includes a holding pan for receiving contaminated solvent with a top unit overlying the holding pan and including a washing basin formed within for receiving fresh solvent. A solvent reservoir assembly mounted on the top unit includes a mounting bracket for holding a solvent container and lid. A solvent flushing unit includes a plunger which activates a biassing element which removes a sealing element from contact with a drain in the washing basin. Contaminated solvent flows from the washing basin into the pan and fresh solvent flows from the solvent reservoir assembly into the washing basin.

DESCRIPTION OF THE PREFERRED EMBODIMENT

Figure 1:
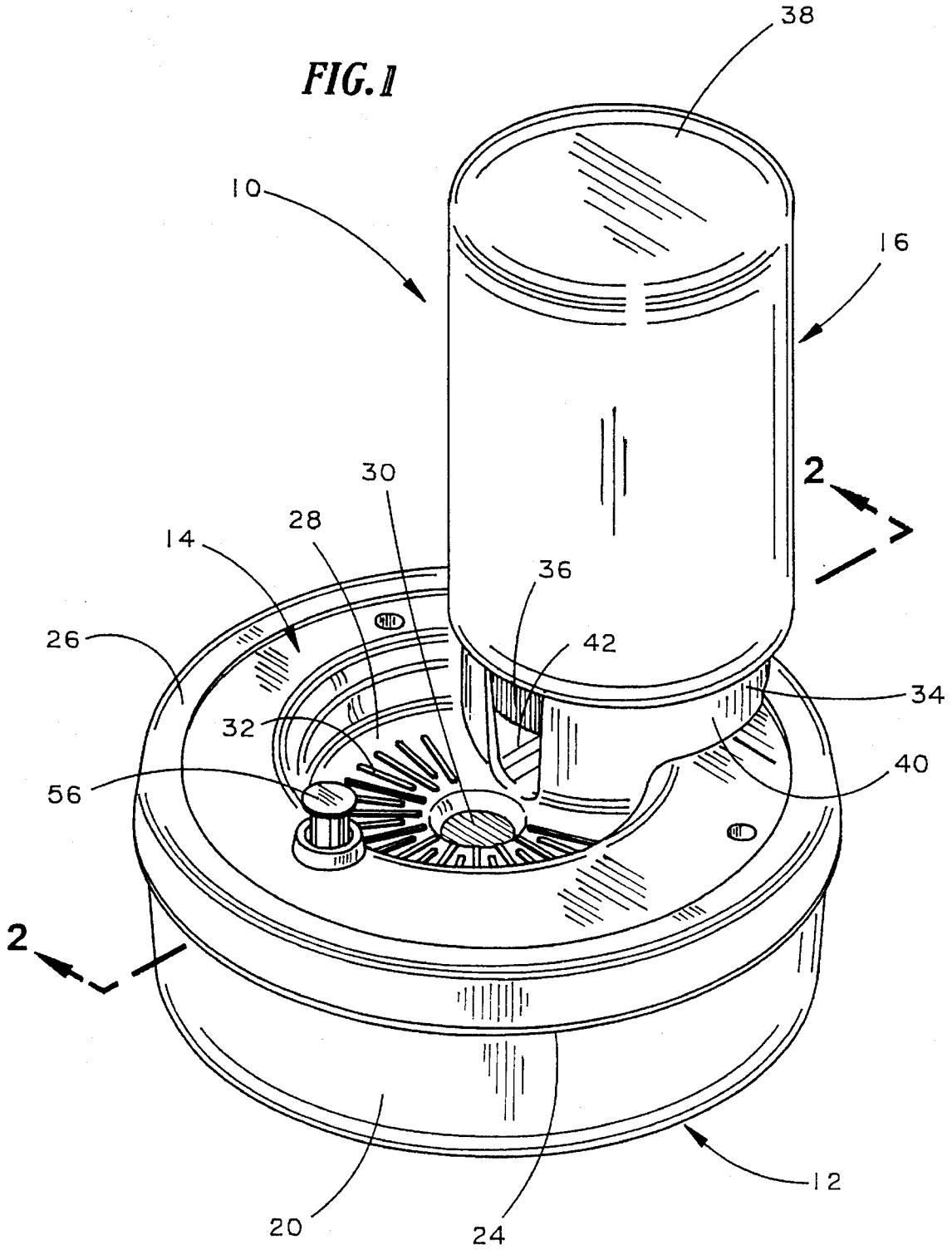
FIG. 1 is a perspective view of the artist's brush washing apparatus of the present invention.
Figure 2:
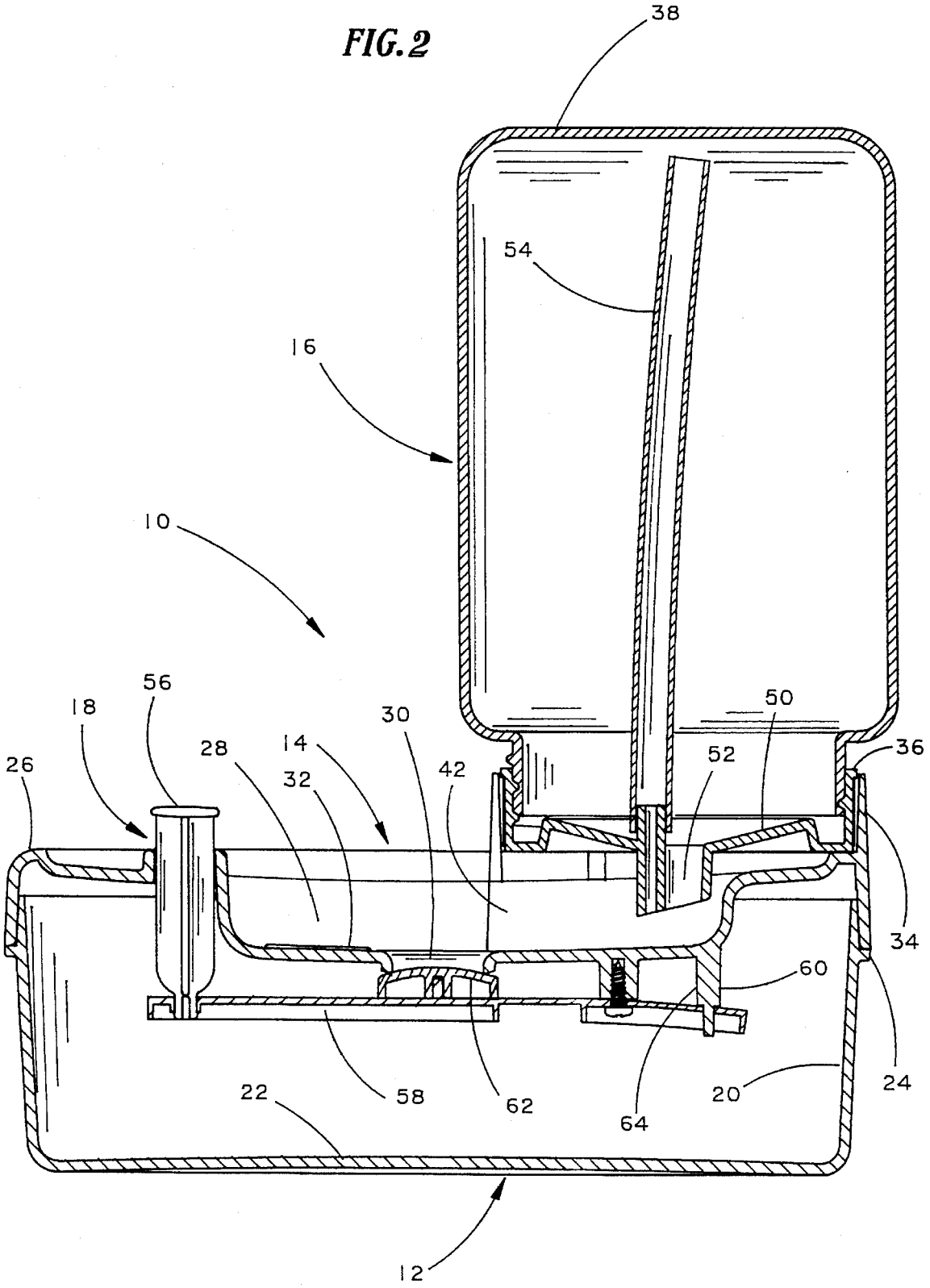
FIG. 2 is a cross-sectional view taken along lines 2—2 of FIG. 1.
Figure 3:
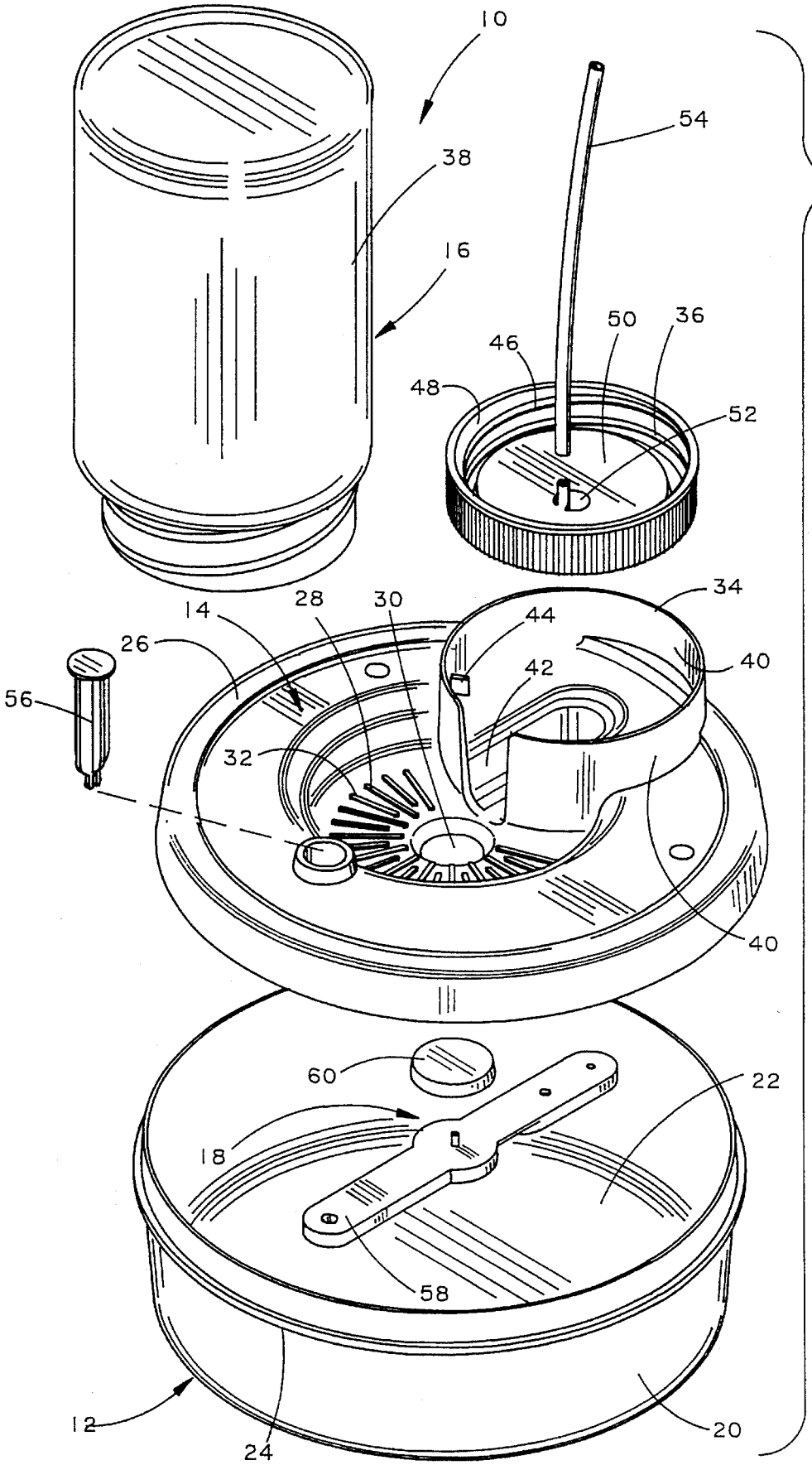
FIG. 3 is an exploded view of the artist brush washing apparatus.
Figure 4:
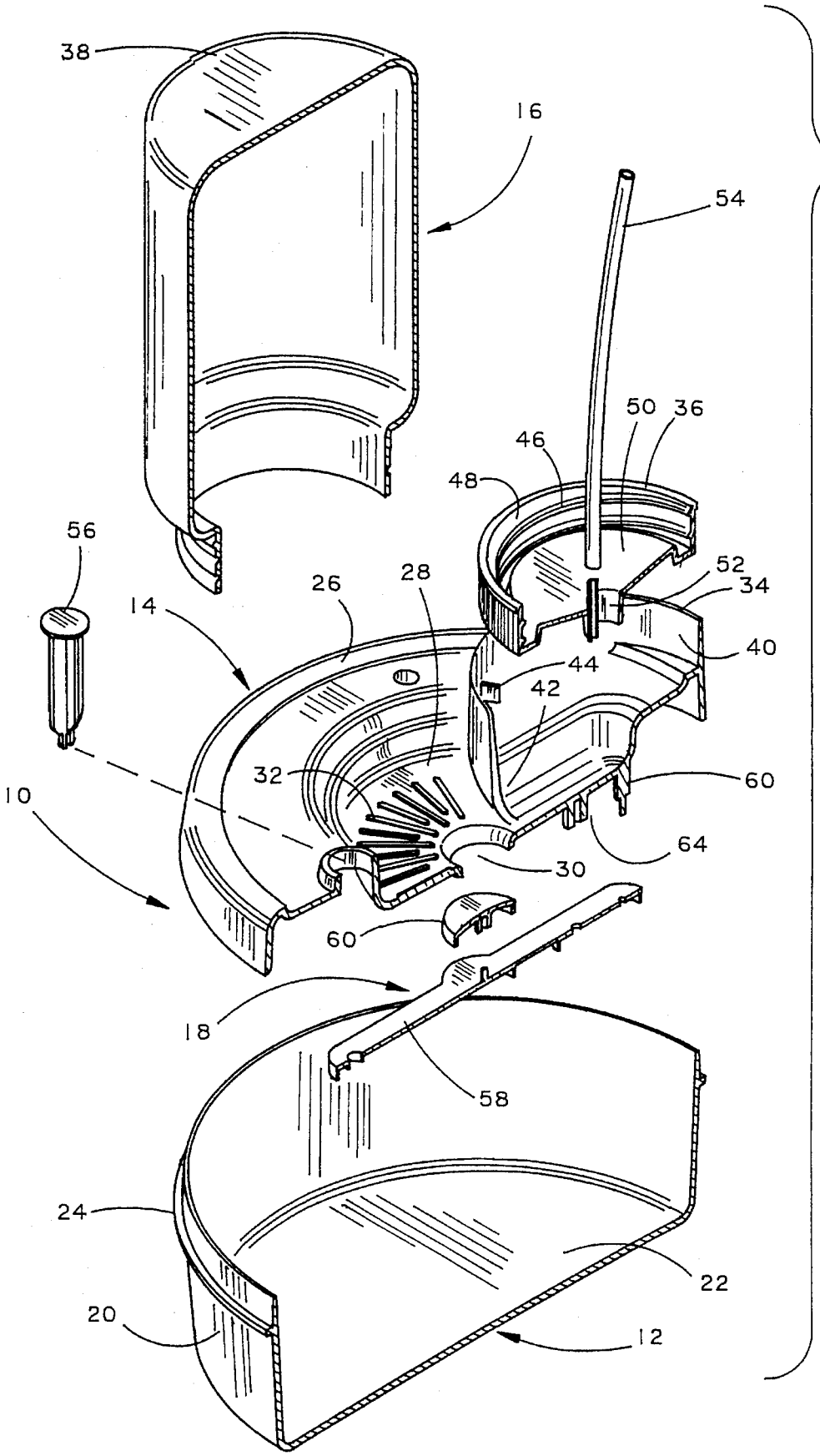
FIG. 4 is a perspective—exploded view of the invention.
Figure 5:
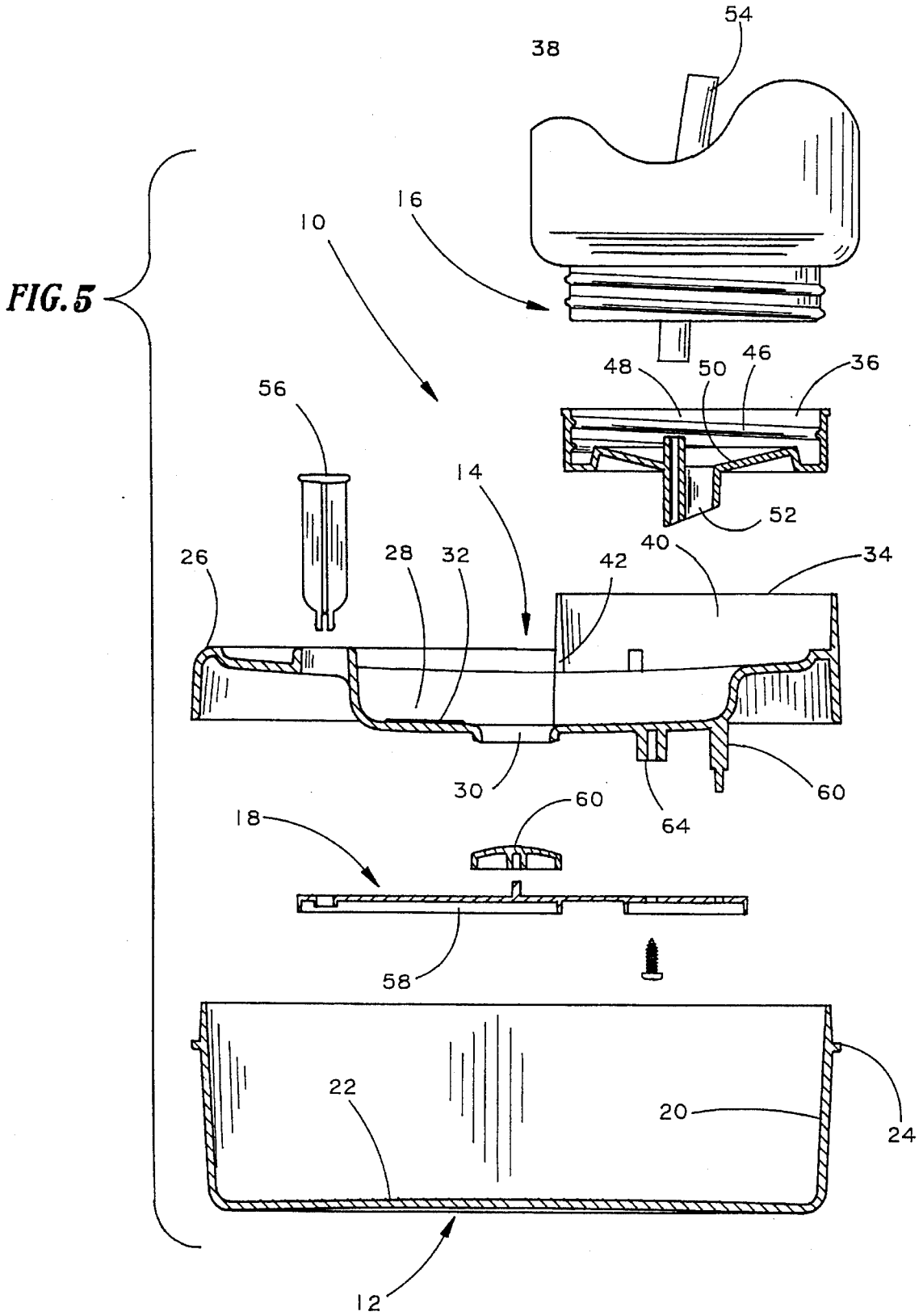
FIG. 5 is a cross-sectional exploded view of the invention.

Referring to the drawings wherein reference numerals designate identical or corresponding parts throughout the several views, the artist's brush washing apparatus of the present invention is illustrated generally at 10 in FIG. 1.

Specifically, the brush washing apparatus 10 includes a solvent holding pan 12 (FIGS. 1–5), a top unit 14, a solvent reservoir assembly 16, and a solvent flushing unit 18. The solvent holding pan 12 is of a conventional design with upright walls 20 and a solid bottom 22 which enables the pan 12 to hold a liquid substance. The upper portion of the wall 20 includes a ridge 24. The top unit 14 includes an outer ring 26 which forms a lip and extends over the wall 20 of the pan 12 and contacts the ridge 24 thereby forming support for the top unit 14. A washing basin 28 is formed inside of the ring 26 which is recessed inwardly forming an internal area which holds a washing solvent. An aperture forms a drain 30 to allow the flow of solvent from the washing basin 28 into the pan 12. Ribs 32 extend radically from the drain 30 on the bottom of the washing basin 28. The ribs 32 assist in the removal of material from a brush during the washing of the brush.

The solvent reservoir assembly 16 (FIGS. 1–5) includes a mounting bracket 34, solvent container lid 36, and solvent container 38. The mounting bracket 34 forms a base for securely holding the lid 36 removably in place on the washing apparatus 10. The mounting bracket 34 includes a curved wall 40 which extends upward from the top unit 14 with a trough 42 extending through the wall 40. A peg 44 forms support for the lid 36 and a similar peg (not illustrated) is opposite peg 44 on the mounting bracket 34. Further, additional support is provided by the ring 26 of the top unit 14 for the lid 36. The lid 36 is conventionally circular in design with an on/off coupling threading 46 on the inside of the wall 48. The bottom 50 of the lid 36 includes nozzle 52 for the solvent to pass through from the solvent container 38 with an equalization tube 54 extending there along and into the solvent container 38 to reduce the formation of a vacuum within the solvent container 38 as the solvent drains out of it.

The solvent flushing unit 18 includes a plunger 56 which extends through the top unit 14 to contact one end of a flexible biassing element 58. The opposing end of the biassing element 58 is rigidly attached to the under side of the washing basin 28 on a friction peg 60 and includes a sealing element 62 positioned midway through the length of the biassing element 58 and in alignment with the aperture forming the drain 30. The biassing element 58 further contacts a rigid support shaft 64 with a screw 66 tightly holding the biassing element 58 in contact with the shaft 64 between the peg 60 and a sealing element 62. The length of the shaft 64 is slightly less than the peg 60 to permit the biassing element 58 to exert upward pressure on the sealing element 62 to hold the sealing element 62 against the drain 30. The sealing element 62 is formed from a resilient flexible material which conforms to the shape of the drain 30 and to seal the drain 30. The downward movement of the plunger 56 moves the sealing element 58 downward from the drain 30 and permits the flow of contaminated solvent from the drain 30.

During the operation of the artist's brush washer unit 10, the particular type of solvent utilized will be dependent of the medium of the paint being used, i.e., water color or acrylic—water, and oil—turpentine, or other appropriate solvents compatible with the medium. The container 38 is filled with fresh solvent and the lid 36 is firmly attached to it. The container 38 is inverted with the lid 36 resting on a mounting bracket 34 (FIGS. 1–5). The solvent flows into the washing basin 28 through the nozzle 52 and fills the washing basin 28 to the level corresponding to the depth of the bottom of the nozzle 52. The cleansing of the brush occurs in the washing basin 28 when the brush is immersed within the solvent and the bristles contact the ribs 32 to facilitate the cleaning of the brush. After the cleaning of the brush, the contaminated solvent is removed from the washing basin 28 when the plunger 56 is depressed downward which disengages the sealing element 62 from the drain 30. The contaminated solvent flows into the pan 12 and fresh solvent flows into the washing basin 28 as the level of the contaminated solvent drops below the nozzle 52. Upon releasing the plunger 56, the sealing element 62 is moved upward by the biassing element 58 which effectively seals the drain 30. The fresh solvent continues to flow into the washing basin until it reaches a level approximately that of the bottom of the nozzle 52.

The volume of the solvent container 38 and the pan 12 permit many cycles of the washing process to occur with minimal interference of the painting process. The pan 12 is further adapted to hold the contaminated solvent until a proper disposal site is secured and removal of the solvent container 38 allows the unit 10 to become portable.

Obviously, many modifications and variations of the present invention are possible in light of the above teachings. It is, therefore, to be understood that, within the scope of the pending claims, the invention may be practiced otherwise than as specifically described. To the extent other embodiments are herein created, it is intended they fall within the scope of protection provided by the claims appended hereto.

I claim:

1. An artist's bush washing apparatus providing multiple cleaning cycles utilizing fresh solvent and storage of a contaminated solvent, comprising:

a holding pan, the holding pan comprised of an upright structure having a bottom communicating therewith for holding contaminated solvent;

a top unit means, the top unit means located above the holding pan and including a washing basin, the washing basin adapted to hold solvent during the brush washing process;

a solvent reservoir means, the solvent reservoir means in communication with the washing basin for the controlled introduction of fresh solvent into the washing basin; and a solvent flushing means, the solvent flushing means controllable for the removal of contaminated solvent from the washing basin and the introduction of fresh solvent into the washing basin, including a plunger, the plunder extending through the top unit means and contacting a biassing element, the biassing element extending along the underside of the washing basin and rigidly secured to the washing basin on the end opposite the plunger and passing underneath the drain, a sealing element, the sealing element attached to the biassing element and in contact with the drain to seal the drain.

2. The artist's brush washing apparatus as claimed in claim 1 wherein the top unit means further includes a drain, the drain being controllable to permit the flow of solvent from the washing basin to the holding pan.

3. The artist's brush washing apparatus as claimed in claim 2 wherein the solvent reservoir means further includes a mounting bracket, a solvent container and lid, the mounting bracket secured to the top unit means and the lid removably attached to the solvent container and held in an inverted position by the mounting bracket.

* * * * *